US009493862B2

(12) United States Patent
Kang

(10) Patent No.: US 9,493,862 B2
(45) **Date of Patent: *Nov. 15, 2016**

(54) WEAR-RESISTANT ALLOY HAVING COMPLEX MICROSTRUCTURE

(71) Applicant: Hyundai Motor Company, Seoul (KR)

(72) Inventor: Hee Sam Kang, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/270,674

(22) Filed: May 6, 2014

(65) Prior Publication Data

US 2014/0334970 A1 Nov. 13, 2014

(30) Foreign Application Priority Data

May 7, 2013 (KR) ..... 10-2013-0051294

(51) Int. Cl.
*C22C 21/10* (2006.01)

(52) U.S. Cl.
CPC ..... *C22C 21/10* (2013.01)

(58) Field of Classification Search
CPC ..... C22C 21/10
See application file for complete search history.

(56) References Cited

U.S. PATENT DOCUMENTS

| | | | | |
|---|---|---|---|---|
| 4,452,866 | A | 6/1984 | Kamiya et al. | |
| 4,650,528 | A * | 3/1987 | Masumoto et al. | 148/437 |
| 6,605,370 | B2 * | 8/2003 | Wittebrood et al. | 428/652 |
| 2013/0095345 | A1 | 4/2013 | Maki et al. | |

FOREIGN PATENT DOCUMENTS

| | | | |
|---|---|---|---|
| GB | 769483 | A | 3/1957 |
| JP | 05-078708 | A | 3/1993 |
| JP | 05-332364 | A | 12/1993 |
| JP | 07-197165 | A | 8/1995 |
| JP | 2000-096162 | A | 4/2000 |
| JP | 2002-012959 | A | 1/2002 |
| JP | 2005-076107 | A | 3/2005 |
| JP | 2005530032 | A | 10/2005 |
| JP | 2008542534 | A | 11/2008 |
| JP | 2011510174 | A | 3/2011 |
| JP | 2011514434 | A | 5/2011 |
| JP | 2013518184 | A | 5/2013 |
| KR | 94-002690 | B1 | 3/1994 |
| KR | 10-0670228 | B1 | 1/2007 |

(Continued)

OTHER PUBLICATIONS

Kaufman, J. Gilbert Rooy, Elwin L.. (2004). Aluminum Alloy Castings—Properties, Processes, and Applications—2. Aluminum Casting Alloys. ASM International. Online version available at: http://app.knovel.com/hotlink/pdf/id:kt00ASDWF1/aluminum-alloy-castings/aluminum-casting-alloys.*

(Continued)

*Primary Examiner* — Roy King
*Assistant Examiner* — Jophy S Koshy
(74) *Attorney, Agent, or Firm* — Mintz Levin Cohn Ferris Glovsky and Popeo, P.C.; Peter F. Corless

(57) ABSTRACT

A wear-resistant aluminum alloy having a complex microstructure may include a range of about 19 to 27 wt % of zinc (Zn); a range of about 3 to 5 wt % of tin (Sn); a range of about 0.6 to 2.0 wt % of iron (Fe); and a balance of aluminum (Al).

3 Claims, 1 Drawing Sheet

(56) References Cited

FOREIGN PATENT DOCUMENTS

| | | | |
|---|---|---|---|
| KR | 10-2008-0053472 | A | 6/2008 |
| KR | 10-2008-0102560 | | 11/2008 |
| KR | 10-2011-0097547 | A | 8/2011 |
| KR | 10-2012-0102865 | A | 9/2012 |
| WO | 2011/161833 | A1 | 12/2011 |

OTHER PUBLICATIONS

W.S Miller, L Zhuang, J Bottema, A.J Wittebrood, P De Smet, A Haszler, A Vieregge, Recent development in aluminium alloys for the automotive industry, Materials Science and Engineering: A, vol. 280, Issue 1, Mar. 15, 2000, pp. 37-49.*

* cited by examiner

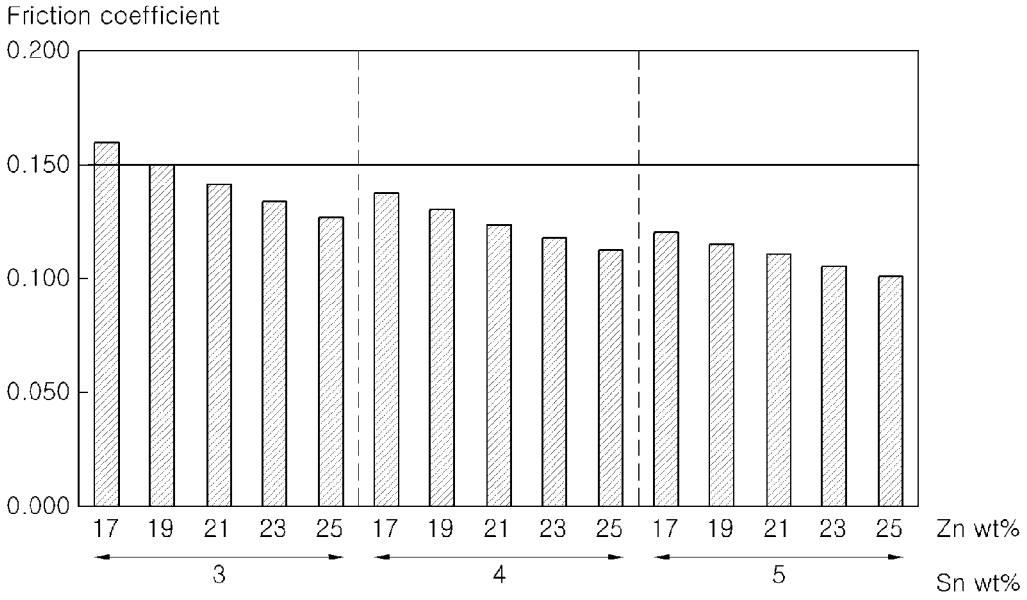
Friction coefficient
0.200
0.150
0.100
0.050
0.000
17 19 21 23 25 17 19 21 23 25 17 19 21 23 25
Zn wt%
3
4
5
Sn wt%

WEAR-RESISTANT ALLOY HAVING COMPLEX MICROSTRUCTURE

CROSS REFERENCE TO RELATED APPLICATION

The present application claims priority of Korean Patent Application Number 10-2013-0051294 filed on May 7, 2013, the entire contents of which application are incorporated herein for all purposes by this reference.

TECHNICAL FIELD

The present invention relates to an aluminum alloy used in vehicle parts which may require wear resistance and self-lubricity, and a method of preparing the aluminum alloy. In particular, the aluminum alloy having a complex microstructure, which may include wear-resistant hard particles and self-lubricating soft particles, is provided.

BACKGROUND

As a wear-resistant aluminum alloy for automobile parts, a hypereutectic aluminum-iron (Al—Fe) alloy containing from about 13.5 to about 18 wt %, or particularly about 12 wt % or greater of silicon (Si) and from about 2 to about 4 wt % of copper (Cu) has been generally used. Since such conventional hypereutectic Al—Fe alloy has a microstructure containing primary solid silicon (Si) particles, it may have improved wear resistance compared to mere Al—Fe alloys, and thus it may be generally used in vehicle parts which require wear resistance, such as shift forks, rear covers, swash plates, and the like.

An example of commercial alloys may include an R14 alloy (Ryobi Corporation, Japan), a K14 alloy, which is similar to the R14 alloy, and an A390 alloy which is used for monoblocks or aluminum liners.

However, since such hypereutectic alloys include a large amount of silicon (Si), their castability may be deteriorated; adjusting the size and the distribution of silicon particles may be difficult; and their impact resistance may be reduced. Furthermore, manufacturing cost may be higher than those of other aluminum alloys because they are specially-developed alloys.

Meanwhile, an Al—Sn alloy may be another example of self-lubricating aluminum alloy for vehicle parts. Since the Al—Sn alloy contains from about 8 to about 15 wt % of tin (Sn), self-lubricating tin (Sn) soft particles may be formed with microstructure, thereby reducing friction. Therefore, this Al—Sn alloy may be used as a base material for metal bearings used in high frictional contact interfaces. However, this Al—Sn alloy may have reduced strength of about 150 MPa or less, although the strength thereof may be enhanced by silicon (Si) content. Therefore, such Al—Sn alloy may not be used for structural parts of a vehicle.

The description provided above as a related art of the present invention is just merely for helping understanding of the background of the present invention and should not be construed as being included in the related art known by those skilled in the art.

SUMMARY OF THE INVENTION

Accordingly, the present invention may provide a technical solution to above-described problems. In particular, the present invention provides a novel high-strength wear-resistant aluminum alloy having a complex microstructure which may contain both hard particles and soft particles. Therefore, the novel alloy may have both the wear resistance from a hypereutectic Al—Fe alloy and the self-lubricity from an Al—Sn alloy.

In one exemplary embodiment of the present invention, a wear-resistant aluminum alloy having a complex microstructure may include: a range of about 19 to 27 wt % of zinc (Zn); a range of about 3 to 5 wt % of tin (Sn); a range of about 0.6 to 2.0 wt % of iron (Fe); and a balance of aluminum (Al). The wear-resistant aluminum alloy may further include a range of about 1 to 3 wt % of copper (Cu). The wear-resistant aluminum alloy may also include a range of about 0.3 to 0.8 wt % of magnesium (Mg). In addition, the wear-resistant aluminum alloy may further include a range of about 1 to 3 wt % of copper (Cu) and a range of about 0.3 to 0.8 wt % of magnesium (Mg).

In another exemplary embodiment of the present invention, a wear-resistant aluminum alloy having a complex microstructure may include: a range of about 19 to 27 wt % of zinc (Zn); a range of about 3 to 5 wt % of bismuth (Bi); a range of about 0.6 to 2.0 wt % of iron (Fe); and a balance of aluminum (Al).

It is understood that weight percents of alloy components as disclosed herein are based on total weight of the alloy, unless otherwise indicated.

The invention also provides the above alloys that consist essentially of, or consist of, the disclosed materials. For example, an alloy is provided that consists essentially of, or consists of, consists essentially of 19 to 27 wt % zinc (Zn), 3-5 wt % tin (Sn), 0.6 to 2.0 wt % iron (Fe), 1 to 3 wt % copper (Cu) and balance of aluminum (Al). In another aspect, an alloy is provided that consists essentially of, or consists of consists essentially of 19 to 27 wt % zinc (Zn), 3-5 wt % tin (Sn), 0.6 to 2.0 wt % iron (Fe), 1 to 3 wt % copper (Cu), 0.3 to 0.8 wt % magnesium and balance of aluminum (Al). In yet another aspect. an alloy is provided that consists essentially of, or consists of, 19 to 27 wt % zinc (Zn), 3-5 wt % bismuth (Bi), 0.6 to 2.0 wt % iron (Fe), and balance of aluminum (Al).

Further provided are vehicles and vehicle parts that comprise one or more of the alloys disclosed herein. Preferred are automobile parts that comprise an alloy as disclosed herein.

Other aspects of the invention are disclosed infra.

BRIEF DESCRIPTION OF THE DRAWINGS

The above and other objects, features and advantages of the present invention will be more clearly understood from the following detailed description taken in conjunction with the accompanying drawing, in which:

FIG. 1 illustrates an exemplary graph showing a correlation between friction coefficient and an amount of Sn or Zn which may form soft particles in a complex microstructure of Examples and Comparative Examples according to an exemplary embodiment of the present invention.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g.

fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

Hereinafter, various exemplary embodiments of the present invention will be described in detail.

The present invention relates to a novel aluminum alloy having a complex microstructure, which may have an aluminum matrix containing both hard particles and soft particles.

In certain examples of conventional alloys, alloy elements for forming self-lubricating particles may include tin (Sn), lead (Pb), bismuth (Bi), and Zn. Since these alloy elements may not chemically react with aluminum, intermetallic compounds may not be produced and phase-separation may not occur. Further, these alloy elements may have a substantially low melting point, and thus they may partially melt under a severe friction condition to form a lubricating film, thereby providing an aluminum alloy with self-lubricity.

Among the above-mentioned alloy elements, lead (Pb) may be the most suitable element for forming self-lubricating particles in consideration of self-lubricity and cost. However, lead (Pb) is classified as a harmful metal element and is prohibited in a vehicle industry. Therefore, tin (Sn) may be used instead of lead (Pb), or alternatively bismuth (Bi) may be used instead of lead (Pb). In addition, zinc (Zn) may be disadvantageous due to its high melting point compared to tin (Sn) and bismuth (Bi), which may deteriorate self-lubricity. Meanwhile, Zn may be added in a substantially large amount because of its low cost. Therefore, zinc (Zn) may be partially used as an alloy element for forming soft particles to replace expensive tin (Sn) or bismuth (Bi), thereby improving the cost competitiveness of a material.

In an exemplary embodiment, alloy elements for forming hard particles may include silicon (Si) and iron (Fe). Silicon (Si) or iron (Fe) may have eutectic reactivity with aluminum (Al) and may form angular hard particles when they are added in a predetermined minimum amount or greater. In exemplary aluminum alloys, silicon (Si) may form hard particles when Si is added to an Al—Fe binary alloy in an amount of about 12.6 wt % or greater. Subsequently, primary solid silicon (Si) particles may be formed, thereby providing the alloy with wear resistance. However, when silicon (Si) is added together with zinc (Zn), which is an element for forming soft particles, the content of silicon (Si) may vary depending on the content of zinc (Zn). For example, when the content of zinc (Zn) is about 10 wt %, silicon (Si) is added in an amount of 7 wt % at minimum to 14 wt % at maximum. When silicon (Si) is added in an amount of less than 7 wt % at minimum, hard particles may not be formed; and when silicon (Si) is added in an amount of greater than 14 wt % at maximum, significant amount of hard particles may be formed, thereby deteriorating the mechanical properties and wear resistance of the alloy.

In Al—Fe alloys, iron (Fe) may be as an impurity. However, in Al—Fe binary alloys containing no silicon (Si), when iron (Fe) is added in an amount of about 0.5 wt % or greater and less than 3 wt %, Al—Fe-based intermetallic compound particles may be formed, thus providing the alloy with wear resistance. In contrast, when iron (Fe) is added in an amount of 3 wt % or greater, Al—Fe-based intermetallic compound particles may be excessively formed, thereby deteriorating the mechanical properties of the alloy and increasing the melting point thereof.

In various exemplary embodiments, alloy elements for enhancing the strength of aluminum alloys may include copper (Cu) and magnesium (Mg). Copper (Cu) may form intermetallic compounds through a reaction with aluminum (Al) and enhance the strength of an aluminum alloy. The effects of copper (Cu) may vary depending on copper (Cu) content, casting/cooling conditions or heat-treatment conditions. Magnesium (Mg) may form intermetallic compounds through a reaction with silicon (Si) or zinc (Zn) and enhance the strength of the aluminum alloy. The effects of magnesium (Mg), likewise copper (Cu), may vary depending on magnesium (Mg) content, casting/cooling conditions or heat-treatment conditions.

Hereinafter, the present invention will be described in detailed exemplary embodiments.

In one exemplary embodiment, the aluminum alloy may include: a range of about 19 to 27 wt % of zinc (Zn), a range of about 3 to 5 wt % of tin (Sn), a range of about 1 to 3 wt % of copper (Cu), a range of about 0.3 to 0.8 wt % of magnesium (Mg), a range of about 0.6 to 2.0 wt % of iron (Fe) for forming hard particles, and a balance of aluminum (Al) as a main component. In particular, when zinc (Zn) is added in an amount of less than about 19 wt %, a insufficient amount of soft Zn particles may be formed, and thus sufficient self-lubricity of the aluminum alloy may not be obtained. When zinc (Zn) is added in an amount of greater than about 27 wt %, the solidius line of the aluminum alloy may be substantially low, thereby deteriorating casting conditions.

Tin (Sn) may have higher self-lubricity but cost higher than zinc (Zn). In particular, when tin (Sn) is added in an amount of less than about 3 wt %, soft Sn particles may not be formed sufficiently, and self-lubricity of soft Zn particles may not be sufficiently obtained. When tin (Sn) is added in an amount of greater than 5 wt %, the friction-reducing effect of the alloy during driving conditions may be insignificant compared to rising cost of Sn, and thus the amount of tin (Sn) may be limited in terms of cost efficiency.

In addition, when iron (Fe) for forming hard particles is added in an amount of less than about 0.6 wt %, Al—Fe-based intermetallic compound particles in forms of hard particles may not be sufficiently formed, for instance, about less than about 0.5%, and thus the aluminum alloy may not have sufficient wear resistance. When iron (Fe) is added in an amount of greater than about 2.0 wt %, liquidius line temperature, at which Al—Fe-based hard particles are formed, may substantially increase, for instance, higher than about 750° C., thereby deteriorating castability and coarsening metallic compound particles.

Copper (Cu) may improve the mechanical properties of an aluminum alloy and copper (Cu) may be added in an amount of about 1 wt % or greater. However, when copper (Cu) is added in an amount of greater than 3 wt %, intermetallic compounds with the other elements may be produced, and thus the mechanical properties of the aluminum alloy may be deteriorated. Therefore, the amount of Cu may be limited. Alternatively, magnesium (Mg), instead of copper (Cu), may be added in an amount of about 0.3 wt % or greater, and thus the mechanical properties of the aluminum alloy may be additionally improved. However, when magnesium (Mg) is added in an amount of greater than about 0.8 wt %, compounds having reduced mechanical properties may be produced. Therefore, the amount of Mg may be limited.

The low friction characteristics of Al—Zn—Sn alloys with respect to soft particles according to an exemplary alloy of the present invention were evaluated. As shown in FIG. 1, exemplary Al—Zn—Sn alloys of Examples 1 to 3 and Comparative Examples 1 and 2 were prepared while changing the contents of Zn and Sn, and then the changes in friction coefficient with respect to each Al—Zn—Sn alloy were measured. As a result, when Sn is added in an amount of about 3 wt % in the Al-3Sn-19Zn alloys of Examples 1 to 3, sufficient low fraction characteristics, for instance, a friction coefficient of about 0.150 or less, may be obtained. However, when Sn is added in an amount of about 3 wt % in the Al-3Sn-17Zn alloys of Comparative Examples 1 and 2, sufficient low fraction characteristics may not be obtained. Therefore, sufficient low fraction characteristics may be obtained only when Zn is added in an amount of about 19 wt % or greater at the minimum Sn content of about 3 wt %. Further, sufficient low friction characteristics may be obtained even when the contents of Sn and Zn increases.

Subsequently, the wear resistance and mechanical properties of exemplary Al-25Zn-4Sn-yFe alloys of Examples 1 to 3 and Comparative Examples 1 and 2 in Table 1, were evaluated.

TABLE 1

| Class. | Al (wt %) | Zn (wt %) | Sn (wt %) | Fe (wt %) | Cu (wt %) | Mg (wt %) | Al—Fe particle fraction (%) | Liquidius line (° C.) | Strength (MPa) |
|---|---|---|---|---|---|---|---|---|---|
| Comp. Ex. 1 | balance | 25 | 4 | 0.4 | 2 | 0.5 | 0.2 | — | — |
| Ex. 1 | balance | 25 | 4 | 0.6 | 2 | 0.5 | 0.5 | — | 320 |
| Ex. 2 | balance | 25 | 4 | 1.6 | 2 | 0.5 | 3.5 | — | — |
| Ex. 3 | balance | 25 | 4 | 2.0 | 2 | 0.5 | 4.5 | 750 | 360 |
| Comp. Ex. 2 | balance | 25 | 4 | 2.2 | 2 | 0.5 | 5 | 755 | — |

Among the Al-25Zn-4Sn-yFe alloys given in Table 1, in the Al-25Zn-4Sn-yFe alloys of Comparative Examples 1 and 2 containing about 0.4 wt % of Fe, insufficient amount, for instance, less than about 0.5%, of Al—Fe-based hard particles may be formed, and sufficient wear resistance may not be obtained. In contrast, when Fe is added in a substantially large amount of about 2.2 wt %, liquidius line temperature, at which Al—Fe-based hard particles are formed, may increase excessively, for instance, higher than about 750° C., thereby deteriorating castability and coarsening metallic compound particles.

In contrast, when Fe is added from about 0.6 to about 2.0 wt % in the Al-25Zn-4Sn-yFe alloys of Examples 1 to 3, sufficient amount of Al—Fe-based hard particles may be formed, and these alloys may have a strength of from about 320 to about 360 MPa, thereby obtaining sufficient wear resistance and mechanical properties.

The wear-resistant aluminum alloy having a complex microstructure according to another exemplary embodiment of the present invention may include: a range of about 19 to 27 wt % of zinc (Zn); a range of about 3 to 5 wt % of bismuth (Bi); a range of about 0.6 to 2.0 wt % of iron (Fe); and a balance of aluminum (Al). In particular, bismuth (Bi) may be used as a strong self-lubricating element instead of tin (Sn).

As described above, the wear-resistant aluminum alloy having a complex microstructure according to the present invention may have both the wear resistance from a hypereutectic Al—Fe alloy and the self-lubricity from an Al—Sn alloy, thereby exhibiting high strength, improved wear resistance and improved self-lubricity.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A wear-resistant aluminum alloy having a complex microstructure, comprising:

a range of about 19 to 25 wt % of zinc (Zn);

a range of about 3 to 5 wt % of tin (Sn);

a range of about 0.6 to 2.0 wt% of iron (Fe);

a range of about 1 to 3 wt % of copper (Cu);

and a balance of aluminum (Al); wherein an Al—Fe particle fraction of the wear-resistant alloy ranges from about 0.5 to about 4.5%; and a friction coefficient of the wear-resistant alloy is about 0.150 or less.

2. The wear-resistant aluminum alloy of claim 1, further comprising a range of about 0.3 to 0.8 wt % of magnesium (Mg).

3. An automotive vehicle part comprising the wear-resistant aluminum alloy of claim 1.

* * * * *